US007578114B2

(12) United States Patent
Duffield et al.

(10) Patent No.: US 7,578,114 B2
(45) Date of Patent: Aug. 25, 2009

(54) WATER-SOLUBLE CONTAINER COMPRISING AT LEAST TWO COMPARTMENTS

(75) Inventors: John Paul Duffield, Beverley (GB); Marcus Guzmann, Leimen (DE)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 480 days.

(21) Appl. No.: 10/475,423

(22) PCT Filed: Apr. 17, 2002

(86) PCT No.: PCT/GB02/01755

§ 371 (c)(1),
(2), (4) Date: Oct. 20, 2003

(87) PCT Pub. No.: WO02/085736

PCT Pub. Date: Oct. 31, 2002

(65) Prior Publication Data

US 2004/0115375 A1 Jun. 17, 2004

(30) Foreign Application Priority Data

Apr. 20, 2001 (GB) ..... 0109675.9

(51) Int. Cl.
*B67B 7/00* (2006.01)

(52) U.S. Cl. ..... 53/476; 53/246; 53/467

(58) Field of Classification Search ..... 53/473, 53/476, 477, 485, 246
See application file for complete search history.

(56) References Cited

U.S. PATENT DOCUMENTS

| | | | | | |
|---|---|---|---|---|---|
| 4,555,354 | A * | 11/1985 | Clarke et al. | ..... | 510/297 |
| 4,637,811 | A * | 1/1987 | Fortney | ..... | 493/167 |
| 4,778,439 | A * | 10/1988 | Alexander | ..... | 493/169 |
| 5,645,169 | A | 7/1997 | Dull et al. | ..... | 206/589 |
| 5,851,634 | A | 12/1998 | Andersen et al. | ..... | 428/159 |
| 5,928,741 | A | 7/1999 | Andersen et al. | ..... | 428/35.7 |
| 6,805,659 | B2 * | 10/2004 | Bohrer | ..... | 493/102 |
| 6,883,295 | B1 * | 4/2005 | Negri et al. | ..... | 53/459 |

FOREIGN PATENT DOCUMENTS

| | | |
|---|---|---|
| DE | 198 06 113 | 8/1999 |
| GB | 1 507 744 | 4/1978 |
| GB | 2 356 842 A | 6/2001 |
| GB | 2 358 382 A | 7/2001 |
| WO | WO 94 29401 | 12/1994 |
| WO | WO 95/19921 | 7/1995 |
| WO | WO 01/36290 | 5/2001 |

OTHER PUBLICATIONS

GB 0109675.9 Search Report dated Oct. 17, 2001.
Abstract of JP 2001 10 10684A (Jan. 16, 2001).
Abstract of JP 10 008098 A (Jan. 13, 1998).
International Search Reort for GB02/01755 Dated Aug. 14, 2002.

* cited by examiner

*Primary Examiner*—Christopher Harmon

(57) ABSTRACT

A process for preparing a water-soluble container comprising at least two compartments which comprises:

Figure 1:
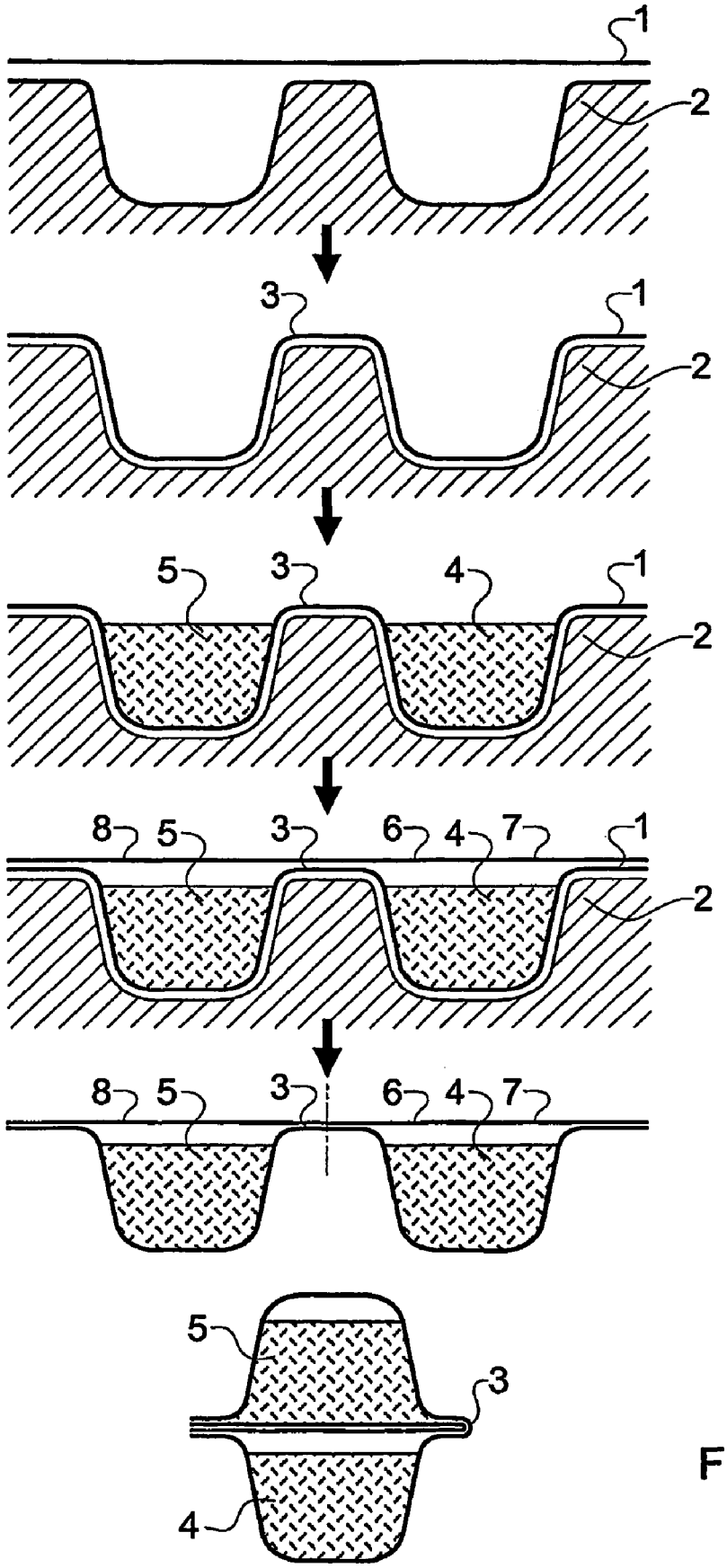

a. providing at least two compartments, each compartment being filled with a composition, and covering each compartment with a lid such that the compartments are joined by a folding portion; and b. folding the folding portion such that the lids of each of the compartments adhere to each other.

16 Claims, 2 Drawing Sheets

WATER-SOLUBLE CONTAINER COMPRISING AT LEAST TWO COMPARTMENTS

This is an application filed under 35 USC 371 of PCT/GB02/01755.

The present invention relates to a water-soluble container comprising at least two compartments and to a process for preparing such a container.

It is known to package chemical compositions, particularly those which may be of a hazardous or irritant nature, in films, particularly water soluble films. Such containers can simply be added to water in order to dissolve or disperse the contents of the container into the water.

For example, WO 89/12587 discloses a package which comprises an envelope of a water soluble material which comprises a flexible wall and a water-soluble heat seal. The package may contain an organic liquid comprising, for example, a pesticide, fungicide, insecticide or herbicide.

WO 92/17382 discloses a package containing an agrochemical comprising a first sheet of non-planar water-soluble or water-dispersible material and a second sheet of water-soluble or water-dispersible material superposed on the first sheet and sealed to it.

Such arrangements have, however, a number of difficulties. In particular, the packages cannot easily contain two or more compositions, because they only have one compartment. Thus they cannot contain two compositions which are incompatible with each other, or a composition which is incompatible with one of the films or sheets used to package the composition unless special precautions are taken.

The present invention provides a process for preparing a water-soluble container comprising at least two compartments which comprises:

a. providing at least two compartments, each compartment being filled with a composition, and covering each compartment with a lid such that the compartments are joined by a folding portion; and
b. folding the folding portion such that the lids of each of the compartments adhere to each other.

The process of the present invention can produce containers which can have a particularly attractive appearance since they contain two compositions, which may be identical or different, held in a fixed position in relation to each other. The compositions can be easily differentiated to accentuate their difference. For example, the compositions can have a different physical appearance, or can be coloured differently. Furthermore the containers can be provided with a shape which may be difficult to produce by other methods. For example, by ensuring that each compartment has a hemispherical shape, the final container can be in the form of a sphere. Additionally, in the containers of the present invention the lids, which may only be of a thin film, are protected since they abut and adhere to each other.

In the process of the present invention at least two compartments are initially provided. Each compartment may be a single compartment or comprise two or more individual compartments. For example each compartment may be separated by one or more dividing walls into two or more individual compartments. The compartments may be formed by any method which produces an open container, for example by vacuum forming, thermoforming, blow moulding or injection moulding.

Any water-soluble polymer (which term is taken to include water-dispersible) may be used to form the compartments. Examples of water-soluble polymers are poly(vinyl alcohol) (PVOH), cellulose derivatives such as hydroxypropyl methyl cellulose (HPMC) and gelatin. An example of a preferred PVOH is ethoxylated PVOH. The PVOH may be partially or fully alcoholised or hydrolysed polyvinyl acetate. For example it may be from 40 to 100%, preferably from 70 to 92%, more preferably about 88% or about 92%, alcoholised or hydrolysed. The degree of hydrolysis is known to influence the temperature at which the PVOH starts to dissolve in water. 88% hydrolysis corresponds to a film soluble in cold (ie room temperature) water, whereas 92% hydrolysis corresponds to a film soluble in warm water.

In a vacuum moulding or thermoforming process a film of the water-soluble polymer is moulded. The film may be a single film, or a laminated film as disclosed in GB-A-2,244,258. While a single film may have pinholes, the two or more layers in a laminate are unlikely to have pinholes which coincide.

The film may be produced by any process, for example by extrusion and blowing or by casting. The film may be unoriented, monoaxially oriented or biaxially oriented. If the layers in the film are oriented, they usually have the same orientation, although their planes of orientation may be different if desired.

The layers in a laminate may be the same or different. Thus they may each comprise the same polymer or a different polymer. If a laminated film is used, each of the layers should be water-soluble.

The thickness of the film used to produce the compartments is preferably 40 to 300 μm, more preferably 70 to 200 μm, especially 80 to 160 μm, more especially 90 to 150 μm and most especially 90 to 120 μm.

The term "water-soluble" when used herein means that when used in a washing machine, such as a fabric or dish washing machine, the water-soluble aspects of the article are substantially (greater than 70%, ideally greater than 85%) dissolved or dispersed into the water. This can be tested by placing the article in 10 liters of agitated water at 45 C for 40 minutes and measuring any undissolved or nondisintegrated pieces of the parts of the article, which are water-soluble, that are left.

In a thermoforming process a film may be drawn down or blown down into a mould. Thus, for example, the film is heated to the thermoforming temperature using a thermoforming heater plate assembly, and then drawn down under vacuum or blown down under pressure into the mould. Plug-assisted thermoforming and pre-stretching the film, for example by blowing the film away from the mould before thermoforming, may, if desired, be used. One skilled in the art can choose an appropriate temperature, pressure or vacuum and dwell time to achieve an appropriate pocket. The amount of vacuum or pressure and the thermoforming temperature used depend on the thickness of the film and on the polymer or mixture of polymers being used. Thermoforming of PVOH films is known and described in, for example, WO 00/55045.

A suitable forming temperature for PVOH or ethoxylated PVOH is, for example, from 90 to 130° C., especially 90 to 120° C. A suitable forming pressure is, for example, 69 to 138 kPa (10 to 20 p.s.i.), especially 83 to 117 kPa (12 to 17 p.s.i.). A suitable forming vacuum is 0 to 4 kPa (0 to 40 mbar), especially 0 to 2 kPa (0 to 20 mbar). A suitable dwell time is, for example, 0.4 to 2.5 seconds, especially 2 to 2.5 seconds.

While desirably conditions chosen within the above ranges, it is possible to use one or more of these parameters outside the above ranges, although it may be necessary to compensate by changing the values of the other two parameters.

In a blow moulding or injection moulding process, the polymer is moulded in a mould. Such techniques are well known. It is a simple matter to incorporate any number of individual compartments, such as 1, 2, 3 or 4 or more, by using a mould of the appropriate shape. The compartments walls produced by these processes are generally rigid. For example, the outside walls and any inside walls may independently have a thickness of greater than 100 μm, for example greater than 150 μm or greater than 200 μm, 300 μm or 500 μm, 750 μm or 1 mm. Wall thicknesses of from 200 μm to 400 μm are preferred. Different wall thicknesses can be used for different compartments in order to ensure that different compartment walls dissolve at different times to release different compositions at different times. This may also be achieved by using different water-soluble polymers which have different dissolution characteristics for different walls.

After the compartments have been formed, they are filled with the desired compositions which are intended to be released in an aqueous environment. Thus, for example, each composition may be an agrochemical composition such as a plant protection agent, for instance a pesticide such as an insecticide, fungicide, herbicide, acaricide, or nematocide, a plant growth regulator or a plant nutrient. Such compositions are generally packaged in amounts of from 0.1 g to 7 kg, preferably 1 to 5 kg, when in solid form. When in liquid or gelled form, such compositions are generally packaged in amounts of from 1 ml to 10 liters, preferably 0.1 to 6 liters, especially from 0.5 to 1.5 liters.

The compositions may also independently be a fabric care, surface care or dishwashing composition. Thus, for example, they may be a dishwashing, water-softening, laundry or detergent composition, or a rinse aid. Such compositions may be suitable for use in a domestic washing machine. The compositions may also independently be a disinfectant, antibacterial or antiseptic composition, or a refill composition for a trigger-type spray. Such compositions are generally packaged in total amounts of from 5 to 100 g, especially from 15 to 40 g. For example, a dishwashing composition may weigh from 15 to 30 g, a water-softening composition may weigh from 15 to 40 g.

The compartments may be completely filled or only partially filled. Each composition independently may be a solid. For example, it may be a particulate or granulated solid, or a tablet. Each composition may also independently be a liquid, which may be thickened or gelled if desired. The liquid composition may be non-aqueous or aqueous, for example comprising less than or more than 5% or less than or more than 10 wt % total or free water. Desirably the compositions contain less than 80 wt % water.

Each composition may have more than one phase. For example each composition may comprise an aqueous composition and a liquid composition which is immiscible with the aqueous composition. Each composition may also comprise a liquid composition and a separate solid composition, for example in the form of a ball, pill or speckles.

The compositions may be the same or different. The container may contain two or more compositions which are incompatible with each other. It may also contain a composition which is incompatible with the part of the container enclosing the other composition. For example, one composition may be incompatible with the part of the container enclosing the other composition because it does not contact this part of the container.

It is possible to ensure that the compositions are released at different times. Thus, for instance, one composition can be released immediately the container is added to water, whereas the other may be released later. This may be achieved by having a compartment which takes longer to dissolve surrounding one of the compositions, which may be either the first or the second composition. This may be achieved by using different wall thicknesses for the compartments. It may also be achieved by choosing polymers which dissolve at different temperatures, for example the different temperatures encountered during the cycle of a laundry or dish washing machine.

The compositions may be appropriately chosen depending on the desired use of the article.

If the article is for use in laundry washing, the primary composition may comprise, for example, a detergent, and the secondary composition may comprise a bleach, stain remover, water-softener, enzyme or fabric conditioner. The article may be adapted to release the compositions at different times during the laundry wash. For example, a bleach or fabric conditioner is generally released at the end of a wash, and a water-softener is generally released at the start of a wash. An enzyme may be released at the start or the end of a wash.

If the article is for use as a fabric conditioner, the primary composition may comprise a fabric conditioner and the secondary component may comprise an enzyme which is released before or after the fabric conditioner in a rinse cycle.

If the article is for use in dish washing the primary composition may comprise a detergent and the secondary composition may comprise a water-softener, enzyme, rinse aid, bleach or bleach activator. The article may be adapted to release the compositions at different times during the laundry wash. For example, a rinse aid, bleach or bleach activator is generally released at the end of a wash, and a water-softener or enzyme is generally released at the start of a wash.

The ingredients of each composition depend on the use of the composition. Thus, for example, the composition may contain surface active agents such as an anionic, nonionic, cationic, amphoteric or zwitterionic surface active agents or mixtures thereof.

Examples of anionic surfactants are straight-chained or branched alkyl sulfates and alkyl polyalkoxylated sulfates, also known as alkyl ether sulfates. Such surfactants may be produced by the sulfation of higher $C_8$-$C_{20}$ fatty alcohols.

Examples of primary alkyl sulfate surfactants are those of formula:

$$ROSO_3^-M^+$$

wherein R is a linear $C_8$-$C_{20}$ hydrocarbyl group and M is a water-solubilising cation. Preferably R is $C_{10}$-$C_{16}$ alkyl, for example $C_{12}$-$C_{14}$, and M is alkali metal such as lithium, sodium or potassium.

Examples of secondary alkyl sulfate surfactants are those which have the sulfate moiety on a "backbone" of the molecule, for example those of formula:

$$CH_3(CH_2)_n(CHOSO_3^-M^+)(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_3(CH_2)_x(CHOSO_3^-M^+)CH_3 \text{ and}$$

$$CH_3(CH_2)_x(CHOSO_3^-M^+)CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a $C_8$-$C_{20}$ alkyl group, preferably $C_{10}$-$C_{18}$ such as a $C_{12}$-$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants which may be employed are salts of fatty acids, for example $C_8$-$C_{18}$ fatty acids, especially the sodium or potassium salts, and alkyl, for example $C_8$-$C_{18}$, benzene sulfonates.

Examples of nonionic surfactants are fatty acid alkoxylates, such as fatty acid ethoxylates, especially those of formula:

$$R(C_2H_4O)_nOH$$

wherein R is a straight or branched $C_8$-$C_{16}$ alkyl group, preferably a $C_9$-$C_{15}$, for example $C_{10}$-$C_{14}$, alkyl group and n is at least 1, for example from 1 to 16, preferably 2 to 12, more preferably 3 to 10.

The alkoxylated fatty alcohol nonionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated nonionic surfactants are Neodol 45-11, which is a similar ethylene oxide condensation products of a fatty alcohol having 14-15 carbon atoms and the number of ethylene oxide groups per mole being about 11. Such products are also available from Shell Chemical Company.

Further nonionic surfactants are, for example, $C_{10}$-$C_{18}$ alkyl polyglycosides, such as $C_{12}$-$C_{16}$ alkyl polyglycosides, especially the polyglucosides. These are especially useful when high foaming compositions are desired. Further surfactants are polyhydroxy fatty acid amides, such as $C_{10}$-$C_{18}$ N-(3-methoxypropyl) glycamides and ethylene oxide-propylene oxide block polymers of the Pluronic type.

Examples of cationic surfactants are those of the quaternary ammonium type.

The total content of surfactants in the composition is desirably 60 to 95 wt %, especially 75 to 90 wt %. Desirably an anionic surfactant is present in an amount of 50 to 75 wt %, the nonionic surfactant is present in an amount of 5 to 50 wt %, and/or the cationic surfactant is present in an amount of from 0 to 20 wt %. The amounts are based on the total solids content of the composition, i.e. excluding any solvent which may be present.

The primary and secondary compositions, particularly when used as laundry washing or dishwashing compositions, may also independently comprise enzymes, such as protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. Desirably the enzymes are independently present in the primary or secondary compositions in an amount of from 0.5 to 3 wt %, especially 1 to 2 wt %, when added as commercial preparations they are not pure and this represents an equivalent amount of 0.005 to 0.5 wt % of pure enzyme.

The primary and secondary compositions may, if desired, independently comprise a thickening agent or gelling agent. Suitable thickeners are polyacrylate polymers such as those sold under the trade mark CARBOPOL, or the trade mark ACUSOL by Rohm and Haas Company. Other suitable thickeners are xanthan gums. The thickener, if present, is generally present in an amount of from 0.2 to 4 wt %, especially 0.5 to 2 wt %.

Primary or secondary compositions used in dishwashing independently usually comprise a detergency builder. The builders counteract the effects of calcium, or other ion, water hardness. Examples of such materials are citrate, succinate, malonate, carboxymethyl succinate, carboxylate, polycarboxylate and polyacetyl carboxylate salts, for example with alkali metal or alkaline earth metal cations, or the corresponding free acids. Specific examples are sodium, potassium and lithium salts of oxydisuccinic acid, mellitic acid, benzene polycarboxylic acids, $C_{10}$-$C_{22}$ fatty acids and citric acid. Other examples are organic phosphonate type sequestering agents such as those sold by Monsanto under the trade mark Dequest and alkylhydroxy phosphonates. Citrate salts and $C_{12}$-$C_{18}$ fatty acid soaps are preferred. Further builders are; phosphates such as sodium, potassium or ammonium salts of mono-, di- or tri-poly or oligo-phosphates; zeolites; silicates, amorphous or structured, such as sodium, potassium or ammonium salts.

Other suitable builders are polymers and copolymers known to have builder properties. For example, such materials include appropriate polyacrylic acid, polymaleic acid, and polyacrylic/polymaleic and copolymers and their salts, such as those sold by BASF under the trade mark Sokalan. The builder is desirably present in an amount of up to 90 wt %, preferably 15 to 90 wt %, more preferable 15 to 75 wt %, relative to the total weight of the composition. Further details of suitable components are given in, for example, EP-A-694, 059, EP-A-518,720 and WO 99/06522.

The primary and secondary compositions can also independently optionally comprise one or more additional ingredients. These include conventional detergent composition components such as further surfactants, bleaches, bleach enhancing agents, builders, suds boosters or suds suppressors, anti-tarnish and anti-corrosion agents, organic solvents, co-solvents, phase stabilisers, emulsifying agents, preservatives, soil suspending agents, soil release agents, germicides, pH adjusting agents or buffers, non-builder alkalinity sources, chelating agents, clays such as smectite clays, enzyme stabilizers, anti-limescale agents, colourants, dyes, hydrotropes, dye transfer inhibiting agents, brighteners, and perfumes. If used, such optional ingredients will generally constitute no more than 15 wt %, for example from 1 to 6 wt %, the total weight of the compositions.

Primary or secondary compositions which comprise an enzyme may optionally contain materials which maintain the stability of the enzyme. Such enzyme stabilizers include, for example, polyols such as propylene glycol, boric acid and borax. Combinations of these enzyme stabilizers may also be employed. If utilized, the enzyme stabilizers generally constitute from 0.1 to 5 wt %, ideally, 0.1 to 1 wt % of the compositions.

The primary and secondary compositions may independently optionally comprise materials which serve as phase stabilizers and/or co-solvents. Example are $C_1$-$C_3$ alcohols such as methanol, ethanol and propanol. $C_1$-$C_3$ alkanolamines such as mono-, di- and triethanolamines can also be used, by themselves or in combination with the alcohols. The phase stabilizers and/or co-solvents can, for example, constitute 0 to 1 wt %, preferably 0.1 to 0.5 wt %, of the composition.

The primary and secondary compositions may independently optionally comprise components which adjust or maintain the pH of the compositions at optimum levels. The pH may be from, for example, 1 to 13, such as 8 to 11 depending on the nature of the composition. For example a dishwashing composition desirably has a pH of 8 to 11, a laundry composition desirable has a pH of 7 to 9, and a water-softening composition desirably has a pH of 7 to 9. Examples of pH adjusting agents are NaOH and citric acid.

The above examples may be used for dish or fabric washing. In particular dish washing formulations are preferred which are adapted to be used in automatic dish washing machines. Due to their specific requirements specialised formulation is required and these are illustrated below Amounts of the ingredients can vary within wide ranges, however preferred automatic dishwashing detergent compositions herein (which typically have a 1% aqueous solution pH of above 8, more preferably from 9.5 to 12, most preferably from 9.5 to 10.5) are those wherein there is present: from 5% to 90%, preferably from 5% to 75%, of builder; from 0.1% to 40%, preferably from 0.5% to 30%, of bleaching agent; from 0.1% to 15%, preferably from 0.2% to 10%, of the surfactant system; from 0.0001% to 1%, preferably from 0.001% to 0.05%, of a metal-containing bleach catalyst; and from 0.1% to 40%, preferably from 0.1% to 20% of a water-soluble silicate. Such fully-formulated embodiments typically further comprise from 0.1% to 15% of a polymeric dispersant, from 0.01% to 10% of a chelant, and from 0.00001% to 10% of a detersive enzyme, though further additional or adjunct ingredients may be present. Detergent compositions herein in granular form typically limit water content, for example to less than 7% free water, for better storage stability.

Non-ionic surfactants useful in ADW (Automatic Dish Washing) compositions of the present invention desirably include surfactant(s) at levels of from 2% to 60% of the composition. In general, bleach-stable surfactants are preferred. Non-ionic surfactants generally are well known, being described in more detail in Kirk Othmer's Encyclopedia of Chemical Technology, 3rd Ed., Vol. 22, pp. 360-379, "Surfactants and Detersive Systems", incorporated by reference herein.

Preferably the ADW composition comprises at least one non-ionic surfactant. One class of non-ionics are ethoxylated non-ionic surfactants prepared by the reaction of a monohydroxy alkanol or alkylphenol with 6 to 20 carbon atoms with preferably at least 12 moles particularly preferred at least 16 moles, and still more preferred at least 20 moles of ethylene oxide per mole of alcohol or alkylphenol.

Particularly preferred non-ionic surfactants are the non-ionic from a linear chain fatty alcohol with 16-20 carbon atoms and at least 12 moles particularly preferred at least 16 and still more preferred at least 20 moles of ethylene oxide per mole of alcohol.

According to one preferred embodiment the non-ionic surfactant additionally comprise propylene oxide units in the molecule. Preferably this PO units constitute up to 25% by weight, preferably up to 20% by weight and still more preferably up to 15% by weight of the overall molecular weight of the non-ionic surfactant. Particularly preferred surfactants are ethoxylated mono-hydroxy alkanols or alkylphenols, which additionally comprises polyoxyethylene-polyoxypropylene block copolymer units. The alcohol or alkylphenol portion of such surfactants constitutes more than 30%, preferably more than 50%, more preferably more than 70% by weight of the overall molecular weight of the non-ionic surfactant.

Another class of non-ionic surfactants includes reverse block copolymers of polyoxyethylene and polyoxypropylene and block copolymers of polyoxyethylene and polyoxypropylene initiated with trimethylolpropane.

Another preferred non-ionic surfactant can be described by the formula:

$$R^1O[CH_2CH(CH_3)O]_x[CH_2CH_2O]_y[CH_2CH(OH)R^2]$$

wherein $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

wherein $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group , x is a value between 1 and 30 and, k and j are values between 1 and 12, preferably between 1 and 5. When the value of x is $\geqq 2$ each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3$ H, methyl or ethyl are particularly preferred. Particularly preferred values for x are comprised between 1 and 20, preferably between 6 and 15.

As described above, in case $x \geqq 2$, each $R^3$ in the formula can be different. For instance, when x=3, the group $R^3$ could be chosen to build ethylene oxide ($R^3$=H) or propylene oxide ($R^3$=methyl) units which can be used in every single order for instance (PO) (EO)(EO), (EO)(PO)(EO), (EO)(EO)(PO), (EO)(EO)(EO), (PO)(EO)(PO), (PO) (PO) (EO) and (PO) (PO) (PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different non-ionic surfactants is particularly preferred in ADW formulations for example mixtures of alkoxylated alcohols and hydroxy group containing alkoxylated alcohols.

The compositions in each compartment may be the same or different. If they are different, they may, nevertheless, have one or more individual components in common.

After the compartments have been filled, the compartments are closed by a lid. The lid may be of any form, so long as it is water-soluble. For example, the lid of each container may be a moulded article, produced by, for example, injection moulding, thermoforming or vacuum forming. An injection moulded lid can especially be used in conjunction with an injection moulded compartment, and suitable attachment and location means may be provided, for example pins or lugs and associated holes. Other examples of lids are films. For example a film may be placed over a filled compartment and, if appropriate or necessary, across any sealing portion, if present.

The thickness of the film used for the lid may be less than the thickness of the film making up the compartment of the container because the film is not subjected to localised stretching in a thermoforming step, if thermoforming is used to form the compartments. It is also desirable to have a thickness which is less than that of the film used to form the first compartment to ensure a sufficient heat transfer through the film to soften the base web if heat sealing is used.

The thickness of the covering film is generally from 20 to 160 μm, preferably from 40 to 100 μm, such as 40 to 80 μm or 50 to 60 μm.

This film may be a single-layered film but is desirably laminated to reduce the possibility of pinholes allowing leakage through the film. The film may be the same or different as the film forming the first compartment. If two or more films are used to form the film comprising the second compartment, the films may be the same or different. Examples of suitable films are those given for the film forming the first compartment.

The lids are sealed to the compartments in order to enclose the compositions. Any method of sealing may be used. For example, the compartments and lids may simply be sealed by the application of pressure to the compartment or lid. This method can especially be used when both the compartment and lid have been prepared by injection moulding and "snap-fit" together. If the lid is in the form of a film it may be sealed to the compartment by any suitable means, for example by means of an adhesive or by heat sealing. Other methods of sealing include infra-red, radio frequency, ultrasonic, laser, solvent, vibration and spin welding. An adhesive such as an aqueous solution of PVOH may also be used. The seal desirably is water-soluble.

If heat sealing is used, a suitable sealing temperature is, for example, 120 to 195° C., for example 140 to 150° C. A suitable sealing pressure is, for example, from 250 to 600 kPa. Examples of sealing pressures are 276 to 552 kPa (40 to 80 p.s.i.), especially 345 to 483 kPa (50 to 70 p.s.i.) or 400 to 800 kPa (4 to 8 bar), especially 500 to 700 kPa (5 to 7 bar) depending on the heat sealing machine used. Suitable sealing dwell times are 0.4 to 2.5 seconds.

One skilled in the art can use an appropriate temperature, pressure and dwell time to achieve a seal of the desired integrity. While desirably conditions are chosen within the above ranges, it is possible to use one or more of these parameters outside the above ranges, although it would might be necessary to compensate by changing the values of the other two parameters.

At this stage of the process of the present invention the compartments are joined by a folding portion. The folding portion may be formed by any means. For example it can comprise a film or layer which is simply attached across two or more containers which have already been closed by lids. However, it is especially desirable for the folding portion to be provided by one or more of the steps used to provide the filled containers as hereinbefore described. For example, the folding portion can be provided when preparing the containers before they are filled. In this instance, the containers are prepared such that at least two containers are joined by the folding portion.

For example, if the containers are prepared by, for example, injection moulding two or more containers may be joined by a thin layer of water-soluble polymer between the containers. Since it may be difficult to prepare a thin folding portion by injection moulding, it may be desirable to provide the folding portion with perforations or to score it in order to assist the subsequent folding operation.

If the containers are formed by, for example, thermoforming, they can again be prepared in such a way that at least two containers are joined by a folding portion. The folding portion can simply be that part of the film which is not formed into a container or pocket to receive the composition.

The folding portion can also, for example, be provided by the component which forms the lids of the containers. For example, if injection moulded lids are used, at least two lids joined by a folding portion are placed on the filled containers. As indicated above, since it may be difficult to prepare a thin folding portion by injection moulding, it may be desirable to provide the folding portion with perforations or to score it in order to assist the subsequent folding operation.

Desirably, however, the folding portion is simply a film, which may be the same as the film constituting the lids of the containers. For example, a single sheet of film may be used as the lid for at least two containers, and the film then acts as the folding portion.

The folding portion may, as indicated above, be provided at the same time that the unfilled containers are prepared, at the same time that the filled containers are lidded or afterwards as a separate component. Any combination of two or more of these may also be used. For example, part of the folding portion may be provided at the same time that the unfilled containers are prepared, and another part, lying on top of the initial part, may be provided at the same time that the containers are lidded.

Thus, for example, in a preferred aspect of the present invention a film of water-soluble polymer is thermoformed into at least two compartments, the compartments being joined by the parts of the film which have not been thermoformed. The compartments are then filled with the desired compositions, and another film of water-soluble polymer placed on top of the filled compartments and sealed to them, the parts of the film which do not cover the compartments also joining the filled compartments. In this case, the folding portion comprises two films. The two films may, if desired, be adhered to each other in the folding portion. For example the films may be laminated in-situ due to the heat within the thermoforming apparatus, or by additional heat. They may also be adhered by an adhesive, such a water or an aqueous solution of PVOH. It is preferred to adhere the films by the use of steam or a solvent in conjunction with heat.

The containers may be produced in pairs, each unit of the pair being joined by the folding portion. The containers may also be produced in strips of two, wherein the folding portion is the middle part of the strip between the lines of containers. The strips of containers may be used in the folding step as is, or individual pairs of containers, or shorter strips, may be prepared by cutting the strips at appropriate points.

Desirably, however, the containers are produced in a two-dimensional array. It is possible, for example, to have an array of up to 12 containers along one side and up to 10 containers along the second side. A suitable array size is four or six containers along one side, and four to eight containers along the other side. An especially preferred array size is eight containers along one side and six containers along the other side. If desired the array can be cut to provide a smaller array of containers, a strip of pairs of containers, or individual pairs. Preferably, however, the array is used as is in the folding step.

In the folding step the folding portions are folded such that the lids of each of the compartments abut and adhere to each other. If the containers are in pairs, the folding portion between each unit of the pair is simply folded. If the containers are in the form of strips of pairs of containers, the strips are folded along the length of each strip. If the containers are in the form of an array, the array is folded along its middle, so that the containers nearest to the folding line are abut each other, and the containers furthest away form the folding line abut each other. The folding operation can be carried out using, for example, s plough type folding machine.

The lids of abutting containers should desirably adhere to each other such that the containers cannot easily be separated. Adhesion can be provided by any means. For example an adhesive may be used, such as water or a solution of PVOH. The adhesive can be applied to the lids by spraying, transfer coating, roller coating or otherwise coating, or the lids can be passed through a mist of the adhesive. Mechanical means such as interlocking lugs may also be used if the lids are stiff enough. The lids can also be made tacky such that they adhere to each other without the need to separate adhesive. Thus they can be heated, or kept at an elevated temperature from the lidding process, such that they adhere to each other when they touch.

Once the containers have been produced, they may be separated from each other by cutting the areas between them. Alternatively, they may be left conjoined and, for example, perforations provided between the individual containers so that they can be easily separated a later stage, for example by a consumer. If the containers are separated, the flanges may be left in place. However, desirably the flanges are partially removed in order to provide an even more attractive appearance. Generally the flanges remaining should be as small as possible for aesthetic purposes while bearing in mind that some flange is required to ensure the two films remain adhered to each other. A flange having a width of 1 mm to 8 mm is desirable, preferably 2 mm to 7 mm, most preferably about 5 mm.

The folding portion, which by this time has been folded, may be retained in the containers. Desirably, however, it is at least partially removed, for example by trimming with a blade, to provide the containers with a more attractive appearance.

The containers of the present invention may have any desired shape. For example, if the two halves of the container are identical, the container can have a regular geometrical shape such as a sphere, cube, cuboid, dodecahedron or cylinder. The cylinder may have any desired cross-section, such as a circular, triangular or square cross-section.

If the two halves of the container are not identical, the container can have a regular or irregular geometrical shape. For example it could have the form of a pyramid, with the smaller compartment forming the apex and the larger compartment forming the base. It could also have the form of an egg or distorted regular geometrical shape. While the completed container may have a regular geometrical shape, the individual compartments may not necessarily be regular or identical. For example, if the final container has a cuboid shape, the individual compartments may have different sizes to accommodate different quantities of compositions.

The compartments may have the same or different size and/or shape. In general, if it is desired to have compartments containing different quantities of components, the compartments have volume ratios of from 2:1 to 20:1, especially from 4:1 to 10:1. The pairs of compartments may have the same lid size and shape for adhering to each other. Alternatively they may have a different size and/or a different shape. It is preferred that if the compartments have a different size, they have the same shape. In this case the lid of the smaller compartment is adhered to only part of the lid of the larger compartment. Two or more smaller compartments can, if desired, be adhered to the lid of the larger compartment.

The container may also have a hook portion so that it can be hung, for example, from an appropriate place inside a dishwashing machine.

The containers produced by the process of the present invention, especially when used for a fabric care, surface care or dishwashing composition, may have a maximum dimension of 5 cm, excluding any flanges. For example, a container may have a length of 1 to 5 cm, especially 3.5 to 4.5 cm, a width of 1.5 to 3.5 cm, especially 2to 3 cm, and a height of 1 to 2 cm, especially 1.25 to 1.75 cm.

The containers may themselves be packaged in outer containers if desired, for example non-water soluble containers which are removed before the water-soluble containers are used.

The containers produced by the process of the present invention will now be further described with reference to FIGS. 1 to 5.

FIG. 1 illustrates an embodiment of the process of the present invention. A film 1 is placed over a thermoforming mould 2 and blown down or drawn down into the mould to form two adjacent pockets joined by a folding portion 3. Both pockets are then filled with liquid compositions 4 and 5 and covered by a lidding film 6 to form two adjacent containers having lids 7 and 8. The containers are then removed from the moulds, and folded along the folding portion 3 such that the lids 7 and 8 abut and adhere to each other.

Figure 2:
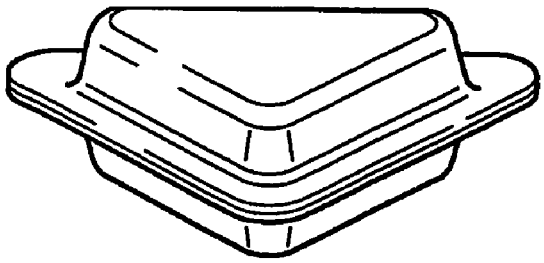
Figure 3:
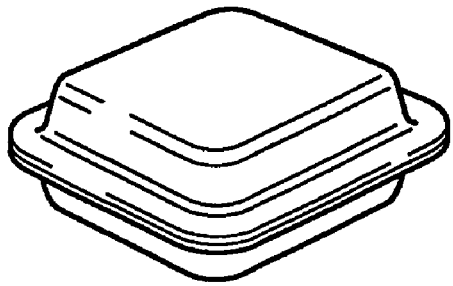
Figure 4:
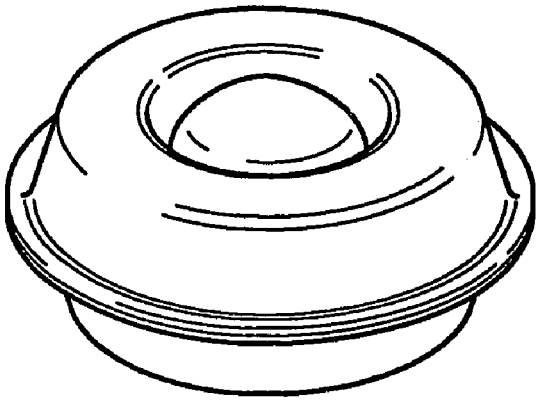

FIGS. 2 to 5 illustrate different containers which can be produced by the process of the present invention. FIGS. 2 and 3 show triangular and rectangular containers. FIG. 4 shows a torroidal container with compartments at the centre.

Figure 5:
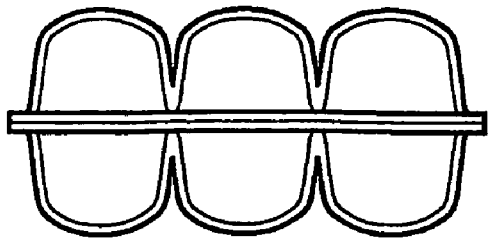

The cross-section taken across a diameter of the container of FIG. 4 is shown in FIG. 5.

The invention claimed is:

1. A process for preparing a water-soluble container comprising at least two compartments which comprises:

a. providing at least two compartments, each compartment being formed of a water-soluble polymer and filled with a composition, and covering each compartment with a water-soluble lid such that the compartments are joined by a folding portion and the composition in each compartment is in contact with the lid; and b. folding the folding portion such that the lids of each of the compartments adhere to each other.

2. A process according to claim 1 wherein the at least two compartments are formed such that they are joined by a folding portion before they are covered by a lid.

3. A process according to claim 2 wherein the compartments are covered by lids which are joined by a folding portion.

4. A process according to claim 1 wherein the compartments are formed by injection moulding.

5. A process according to claim 1 wherein the compartments are formed by thermoforming.

6. A process according to claim 3 wherein each lid is in the form of a film.

7. A process according to claim 3 wherein each lid is heat sealed to the compartment which it covers.

8. A process according to claim 3 wherein the lids are adhered to each other by means of an adhesive.

9. A process according to claim 3 wherein the lids are adhered to each other by tacky surfaces of the lids.

10. A process according to claim 1 wherein at least part of the folding portion is removed after having been folded.

11. A process according to claim 1 wherein the compartments comprise a poly(vinyl alcohol).

12. A process according to claim 1 wherein the lids comprise a poly(vinyl alcohol).

13. A process according to claim 1 wherein the compositions are fabric care, surface care or dishwashing compositions.

14. A process according to claim 13 wherein the compositions are dishwashing, water-softening, laundry or detergent compositions or a rinse aid.

15. A process according to claim 13 wherein the compositions are disinfectant, antibacterial or antiseptic compositions or refill compositions for a trigger-type spray.

16. A process according to claim 1 wherein the compositions are agricultural compositions.

* * * * *